US005558529A

United States Patent [19]

Romatzick, Jr.

[11] Patent Number: 5,558,529

[45] Date of Patent: Sep. 24, 1996

[54] ELECTRICAL CONNECTOR WITH SHUNT SYSTEM

[75] Inventor: David H. Romatzick, Jr., Milford, Conn.

[73] Assignee: Burndy Corporation, Norwalk, Conn.

[21] Appl. No.: 284,795

[22] Filed: Aug. 2, 1994

[51] Int. Cl.[6] ..... H01R 29/00

[52] U.S. Cl. ..... 439/188; 200/51.1

[58] Field of Search ..... 439/157, 188, 439/310, 347; 200/51.1

[56] References Cited

U.S. PATENT DOCUMENTS

| | | | |
|---|---|---|---|
| 4,586,771 | 5/1986 | Kraemer et al. | 339/75 MP |
| 4,875,873 | 10/1989 | Ishizuka et al. | 439/347 |
| 4,902,240 | 2/1990 | Kuzuno et al. | 439/157 |
| 4,906,203 | 3/1990 | Margrave et al. | 439/188 |
| 4,975,074 | 12/1990 | Neidich | 439/310 |
| 5,071,362 | 12/1991 | Martens et al. | 439/188 |
| 5,112,238 | 5/1992 | Cizin | 439/188 |
| 5,346,405 | 9/1994 | Mosser, III et al. | 439/188 |

*Primary Examiner*—Neil Abrams
*Assistant Examiner*—Barry Matthew L. Standig
*Attorney, Agent, or Firm*—Perman & Green

[57] ABSTRACT

An electrical connector comprising a housing, a plurality of first electrical contacts, a shuttle movably mounted inside the housing, and a plurality of second electrical shunt contacts stationarily mounted on the shuttle. The shuttle is movable between two positions to move the shunt contacts into and out of electrical contact with the first electrical contacts. The shuttle has a cam surface that is adapted to be moved along the slot by a second mating electrical connector to move the shuttle and shunt contacts.

17 Claims, 4 Drawing Sheets

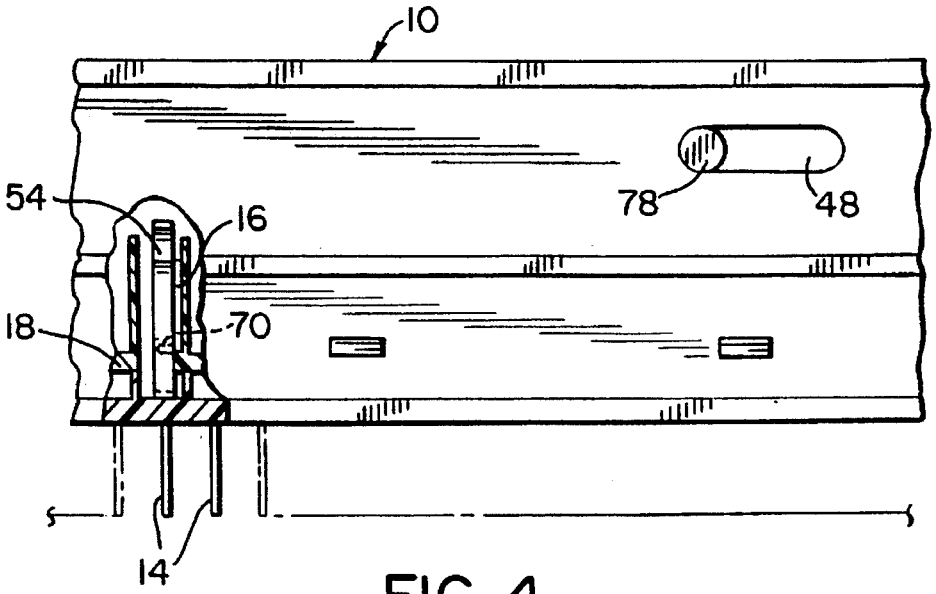
FIG. 4
FIG. 5
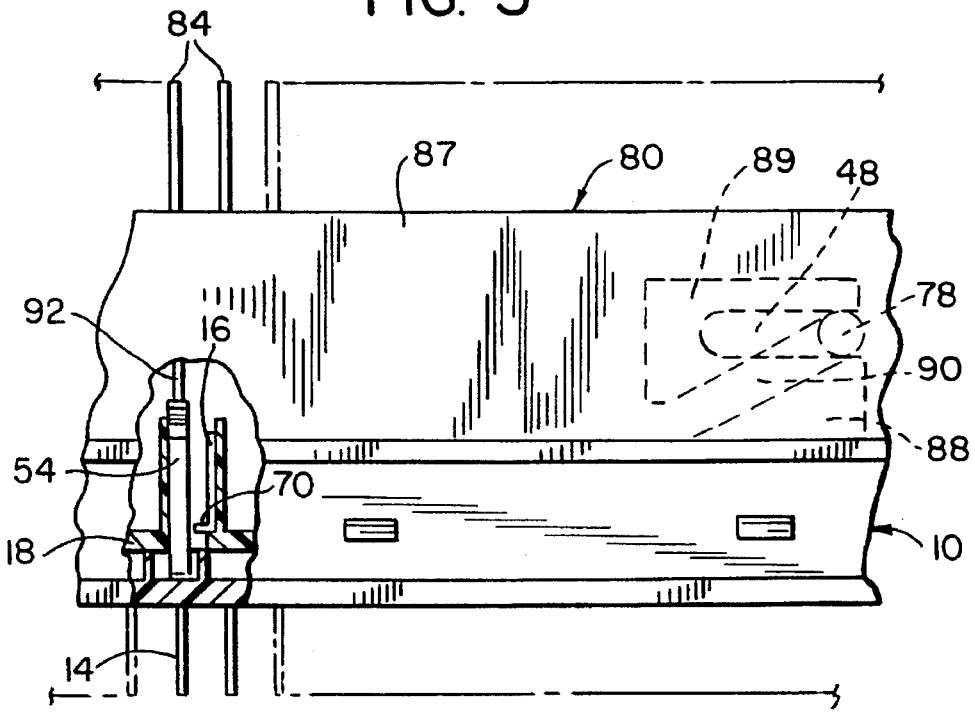

ELECTRICAL CONNECTOR WITH SHUNT SYSTEM

BACKGROUND OF THE INVENTION

1. Field of the Invention

The present invention relates to electrical connectors and, more particularly, to a connector with a system to shunt electrical contacts of the connector.

2. Prior Art

U.S. Pat. No. 4,975,074 discloses a cam activated electrical connector with a pin housing and a terminal housing. The terminal housing has movable shuttle assemblies. U.S. Pat. No. 5,071,362; 5,112,238; and 4,906,203 all disclose electrical connector/contact shorting or shunting. U.S. Pat. Nos. 4,586,771; 4,875,873; and 4,902,240 disclose mating electrical connectors with cams.

SUMMARY OF THE INVENTION

In accordance with one embodiment of the present invention an electrical connector is provided comprising a plurality of first electrical contacts, a housing, a shuttle, and a plurality of second electrical shunt contacts. The housing has the first contacts fixedly contact thereto. The shuttle is movably located inside the housing and has at least one cam surface extending out an aperture of the housing. The plurality of the second electrical shunt contacts are stationary connected to the shuttle. The cam surface is moved by a mating electrical connector to move the second shunt contacts into and out of electrical contact with the first contacts dependent upon location of the mating electrical connector relative to the housing.

In accordance with another embodiment of the present invention an electrical connector assembly is provided comprising a first electrical connector and a second electrical connector. The first electrical connector has a first housing, a plurality of first electrical contacts, a plurality of second electrical shunt contacts, and means for moving each of the second shunt contacts into and out of electrical contact with at least two of the first contacts. The second electrical connector has a second housing and a plurality of third electrical contacts. The third contacts are adapted to make electrical contact with the first contacts when the first and second housings are connected to each other. The second housing has a receiving area for receiving a portion of the first housing. The means for moving is contacted and moved by the second housing between a second position when the second housing is not connected to the first housing and a first position when the second housing is fully mounted on the first housing. The second position comprises the second shunt contacts electrically contacting the first contacts and the first position comprises the second shunt contacts not electrically contacting the first contacts.

In accordance with another embodiment of the present invention an electrical connector is provided comprising a plurality of first electrical contacts, a plurality of second shunt contacts, means for moving the second contacts, and a housing. The means for moving the second contacts can move the second contacts into and out of electrical contacts with the first contacts. The means for moving has a shuttle member with the second contacts mounted thereon. The housing has a base with the first contacts fixedly connected thereto and a cover connected to the base. The shuttle member is movably mounted to the housing in an area between the base and cover. The shuttle is adapted to move the second contacts in the area between the base and cover.

BRIEF DESCRIPTION OF THE DRAWINGS

The foregoing aspects and other features of the invention are explained in the following description, taken in connection with the accompanying drawings, wherein:

FIG. 4 is a partial elevational side view with a cut away section of the electrical connector shown in FIG. 1; and FIG. 5 is a partial elevational side view with a cut away section of the electrical connector shown in FIG. 4 having the connector shown in FIG. 3 connected thereto.

DETAILED DESCRIPTION OF THE PREFERRED EMBODIMENT

Figure 1:
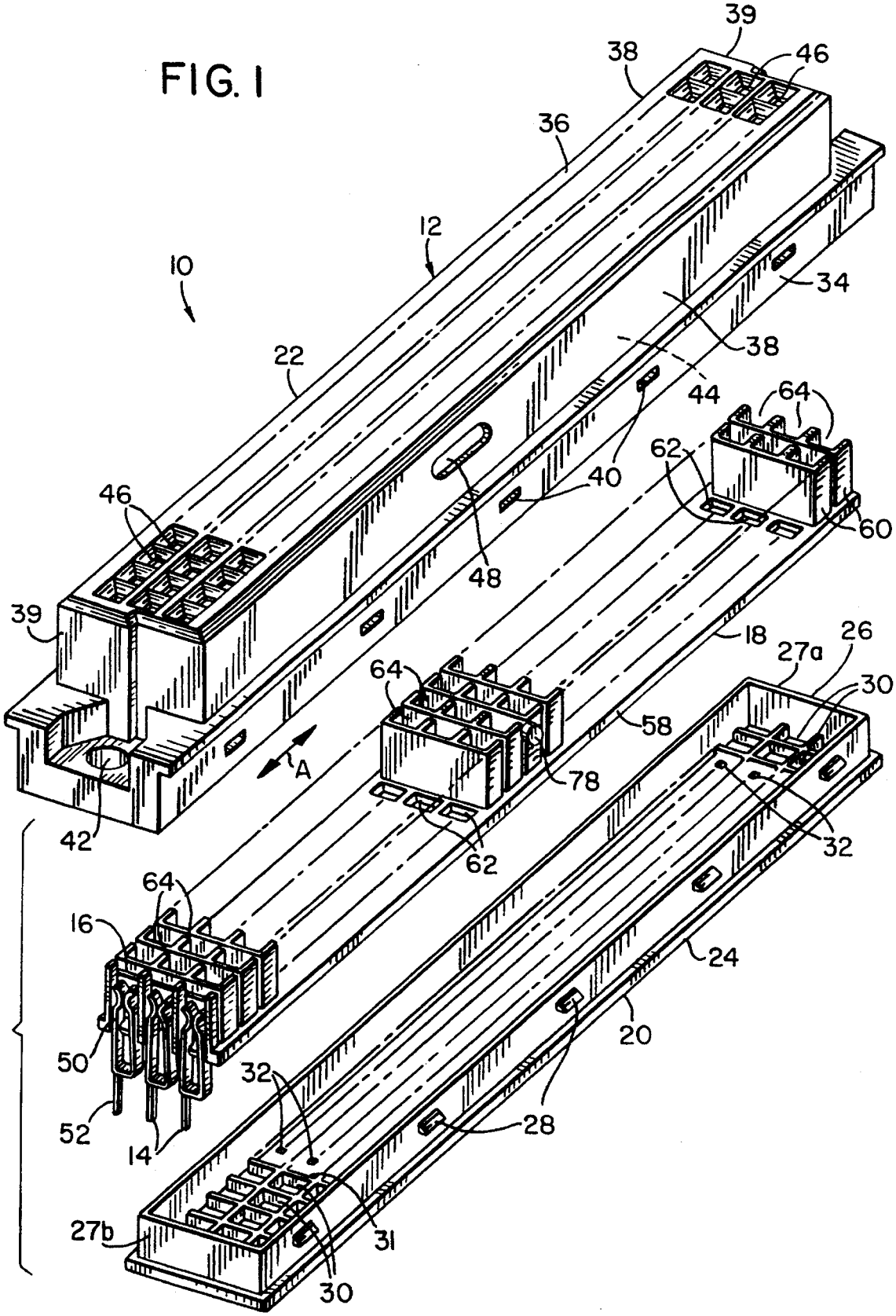
FIG. 1 is an exploded perspective view of an electrical connector incorporating features of the present invention.

Referring to FIG. 1, there is shown an exploded perspective view of an electrical connector 10 incorporating features of the present invention. Although the present invention will be described with reference to the single embodiment shown in the drawings, it should be understood that features of the present invention could be embodied in many different forms of alternate embodiments. In addition, any suitable size, shape or type of elements or materials could be used.

The connector 10 generally comprises a housing 12, a plurality of first electrical contacts 14, a plurality of second shunt contacts 16, and a shuttle 18. The housing 12, in the embodiment shown, includes a base 20 and a cover 22. In alternate embodiments, only one member or more than two members could be used to form the housing. The base 20 and cover 22 are both preferably comprised of a dielectric material, such as a molded plastic or polymer material. The housing 12 has a general elongate shape. The base 20 has a bottom section 24 and an upstanding wall section 26. The wall section 26 includes snap-lock latches 28 along the exterior of its longitudinal sides. The bottom section 24 has compartments 30 formed by a raised pattern 31 and, holes 32 at the bottom of each compartment; one hole 32 for each compartment 30.

The cover 22 has a connection section 34, a top wall 36, and side walls 38 and end walls 39 that extend between the connection section 34 and the top wall 36. The connection section 34 has snap-lock latch holes 40 along its longitudinal sides. Fastener holes 42 (only one of which is shown) are provided at the opposite ends of the connection section 34. A receiving area 44 is provided inside the cover 22 in order to receive the wall section 26 of the base 20 and the shuttle 18. The top wall 36 forms the top to the receiving area 44. The top wall 36 has a plurality of pin apertures 46 therethrough. The pin apertures 46 are provided to allow male pin contacts 92 (see FIG. 3) of a mating second electrical connector 80 to pass therethrough. The side walls 38 each include a cam slot 48 therethrough.

The snap-lock latches 28 cooperate with the snap-lock holes 40 to fixedly stationarily connect the cover 22 and base 20 together. However, in alternate embodiments, other suitable types of connections could be used to connect the cover to the base. In addition, for a single piece housing, suitable means to connect the shuttle 18 to the housing could be provided. In alternate embodiments, any suitable type of housing could be provided.

Figure 2:
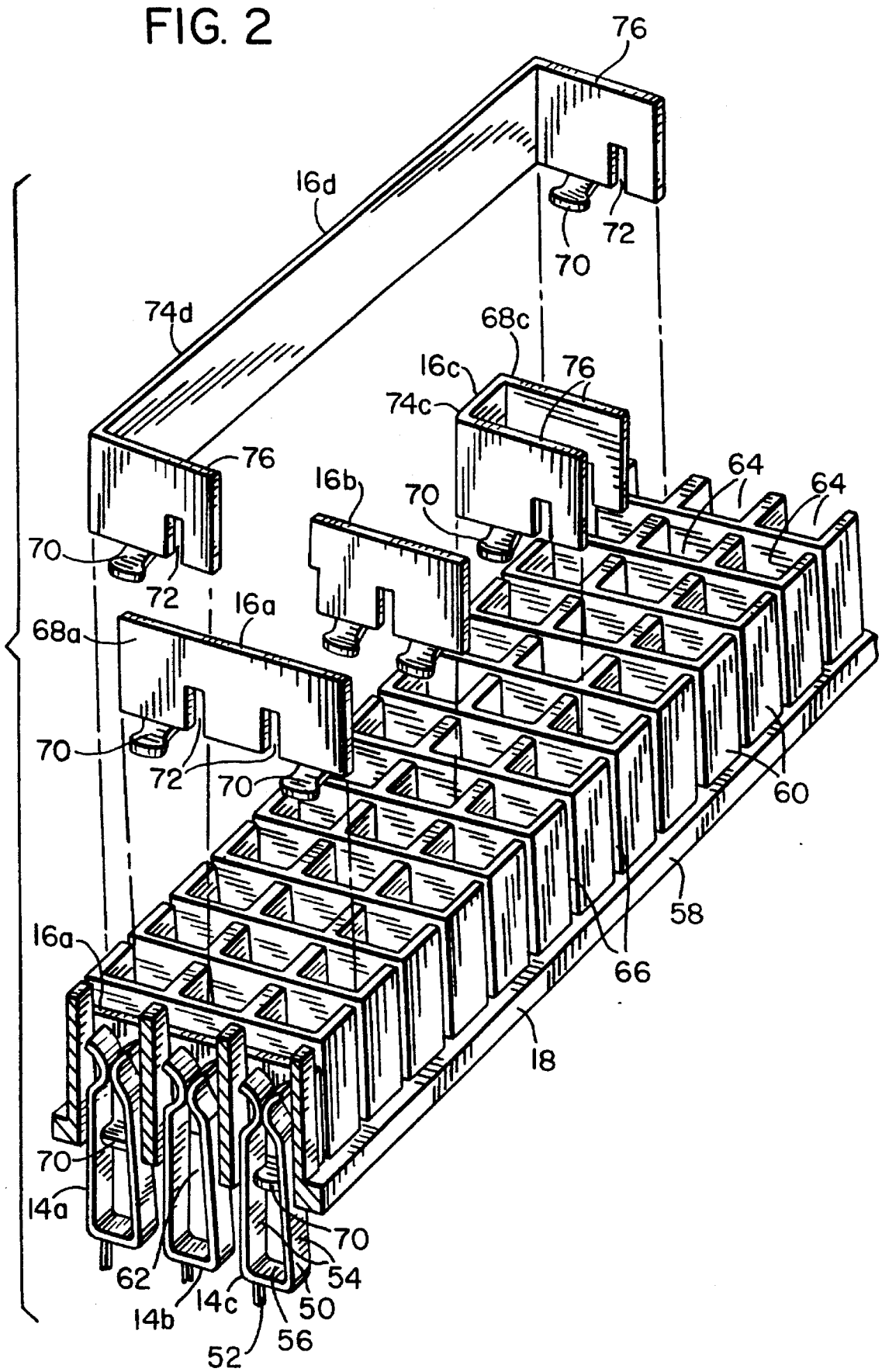
FIG. 2 is a partial perspective view of the shuttle shown in FIG. 1 with an exploded view of some of the shunt contacts.

Referring also to FIG. 2, the first contacts 14 are comprised of electrically conductive material. The first contacts 14 generally comprise a female connection section 50 and a tail end 52. In the embodiment shown, the tail end 52 is in the form of a male through-hole solder tail. However, in alternate embodiments other types of tail ends could be provided, such as a surface mount solder tail. In the embodiment shown, the female section 50 has two opposing cantilever spring contact arms 54 connected by a middle section 56. The tail ends 52 of the first contacts 14 pass through the holes 32 in the housing base 20. A bottom portion of each female connection section 50 is located in the compartments 30 of the housing base 20. The first contacts 14 are fixedly connected to the housing base 20. In alternate embodiments, other suitable types of first contacts could be provided.

The cam tray or shuttle 18, in the embodiment shown, is a one piece rigid dielectric member made of a suitable material, such as a molded plastic or polymer material. However, in alternate embodiments, more than one shuttle could be used and/or a multi-piece shuttle could be used, and/or different types of shuttles could be used. The shuttle 18 is generally provided to move the second shunt contacts 16 into and out of electrical contact with the first contacts 14. The shuttle 18 includes a planer base section 58 and multiple compartment sections 60. The base section 58 has a plurality of apertures 62 therethrough (see FIG. 1). The compartment sections 60 extend perpendicularly upward from the base section 58. In the embodiment shown, each compartment section 60 has three side-by-side compartments 64. A slot 66 is provided between each compartment section 60. In alternate embodiments, any suitable type of shuttle, compartment sections, or compartments could be provided.

The shuttle 18 is movably located in the housing receiving area 44. The base station section 58 of the shuttle 18 slidably rests against the top surface of the raised pattern 31 of the housing base 20. The shuttle 18 is capable of reciprocally moving, as indicated by arrow A in FIG. 1, between two positions inside the housing 12. As noted above, the first contacts 14 are fixedly mounted to the housing base 20. The female contact sections 50 extend upward through the apertures 62 into the compartments 64. The apertures 62 and compartments 64 are suitably sized relative to the first contacts 14 such that the first contacts 14 are accommodated in both positions of the shuttle 18.

The second shunt contacts 16 are comprised of a suitable electrically conductive material. Four examples of different types of shunt contacts are shown in FIG. 2 and numbered 16*a*, 16*b*, 16*c*, 16*d*. The first type of shunt contact 16*a* has a flat planar bridging section 68*a* and two contact sections 70. The contact sections 70 extend in the same direction; generally perpendicular to the planar bridging section 68*a*. The bridging section 68*a* also has notches 72 to accommodate portions of the shuttle compartment sections 60. The bridging section 68*a* is located in one of the slots 66. An interference fit between the bridging section 68*a* and the shuttle 18 at the notches 72 fixedly and stationarily mounts the shunt contact 16*a* to the shuttle 18. The first type of shunt contact 16*a* is suitably configured such that its contact sections 70 are positioned in spaced compartments 64 of the same compartment section 60; no contact section being located in the middle compartment of that section 60. The second type of shunt contact 16*b* is similar to the first type of shunt contact 16*a*, but is adapted to have its two contact sections 70 located in two adjacent compartments 64 of the same compartment section 60. The third type of shunt contact 16*c* has a "U" shaped bridging section 68*c*. The base 74*c* of the "U" shape extends along an exterior longitudinal side of the shuttle 18. The two arms 76 of the "U" shape extend into different slots 66. This positions its two contact sections 70 in compartments 64 of two different compartment sections 60. The fourth type of shunt contact 16*d* is similar to the third type 16*c*, but includes a longer base 74*d*. In alternate embodiments, any suitable type or shape of shunt contacts could be provided including shunt contacts with more than two contact sections.

As seen best in FIG. 2, the contact sections 70 are adapted to be positioned between individual contact arms 54 of some of the first contacts 14. As noted above, the first contacts 14 are fixedly mounted to the housing 12 and the shunt contacts 16 are fixedly mounted to the shuttle 18. Because the shuttle 18 is movably mounted to the housing 12, the shunt contacts 16 are movable relative to the first contacts 14. In the first position of the shuttle 18 in the receiving area 44, the contact sections 70 are spaced from the first contacts 14; i.e.: the shunt contacts 16 are not electrically connected to the first contacts 14. The first position is when the shuttle 18 is located against end 27*a* of the housing base 20. In the second position of the shuttle 18, the contact sections 70 directly contact the interior of the arms 54 of the first contacts 14 that are in the same compartments 64. For example, in the first row of compartments 64 shown in FIG. 2, the contacts sections 70 contact the two outer first contacts 14*a*, 14*c*. Therefore, the two contacts 14*a*, 14*c* are electrically connected to each other by the shunt contact 16*a* in the first compartment section 60. The middle first contact 14*b* is not electrically connected by the shunt contact 16*a*. This second position is when the shuttle 18 is located against end 27*b* of the housing base 20. In an alternate embodiment, the shuttle 18 could move in up and down directions or side-to-side directions rather than merely end-to-end.

In order to move the shuttle 18 between its first and second positions, the shuttle 18 is provided with a cam surface 78 on at least one of its longitudinal sides. In alternate embodiments, the cam surface could be located at any suitable location. The cam surface 78 extends through and projects out of the cam slot 48 of the housing cover 22. The cam surface 78 is slidably located in the slot 48 along a length of the connector; the same length as the shuttle distance of the shuttle 18 between its first and second positions. The cam surface 78 can be moved from outside the housing 12 to thereby move the shuttle 18 between its first and second positions.

Figure 3:
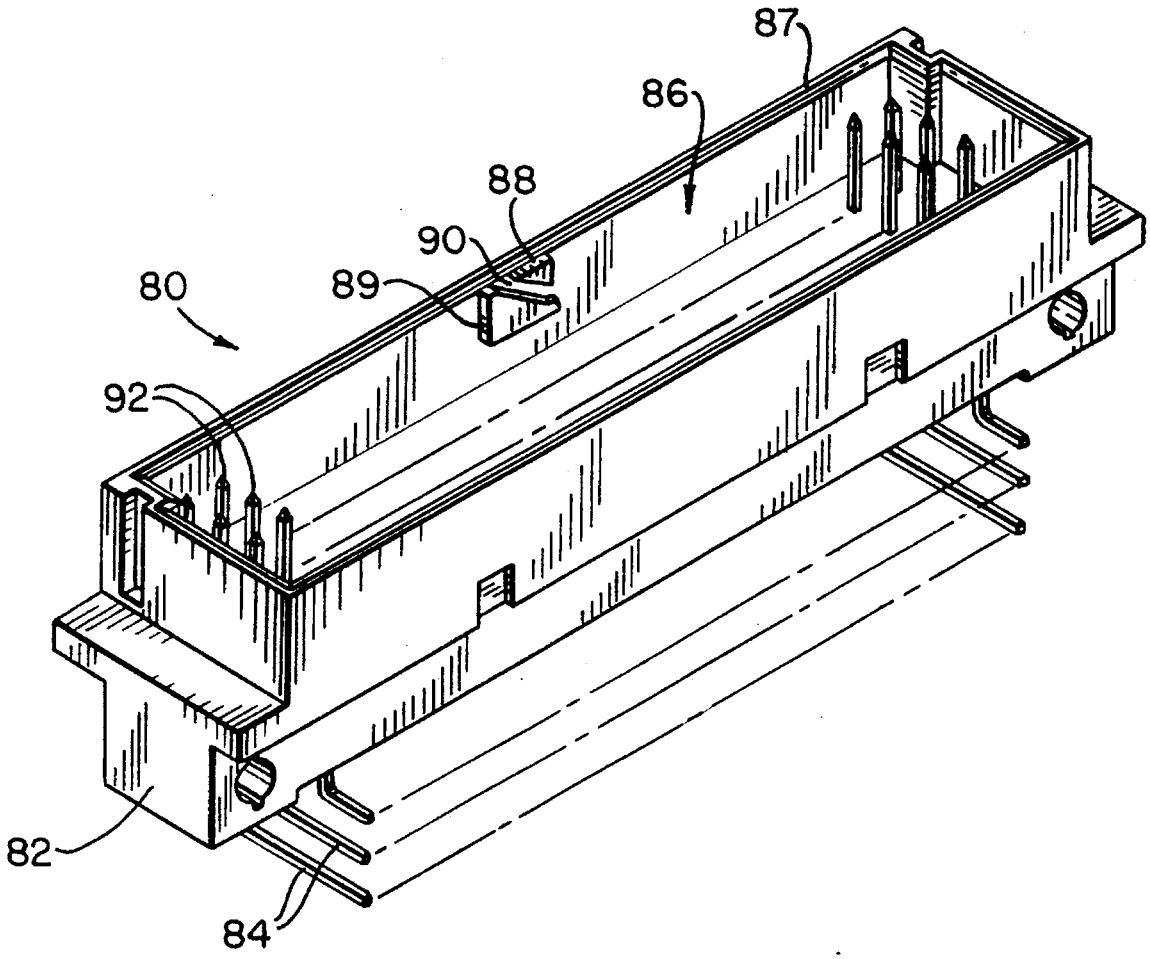
FIG. 3 is a perspective view of a second electrical connector adapted to be mated with the electrical connector shown in FIG. 1.

Referring also to FIG. 3, there is shown a second electrical connector 80 for mating electrical and mechanical connection to the connector 10. The mating connector 80 includes a housing 82 and third electrical contacts 84. In alternate embodiments, any suitable type of mating electrical connector could be provided. The housing 82 has a receiving area 86 that is adapted to receive walls 36, 38, 39 of the first connector's cover 22. An interior of the side wall 87 is provided with cams 88, 89 with a groove 90 therebetween. The third contacts 84 have male pin sections 92 located in the receiving area 86. In alternate embodiments, any suitable type of third contacts could be provided. The pin sections 92 are adapted to pass through the top wall 36 of the cover 22 at the apertures 46 and project into the compartments 64 of the shuttle 18. When the two connectors 10, 80 are fully connected, each of the pin sections 92 project between the opposing arms 54 of individual respective first contacts 14 and make electrical contact therewith.

Referring now also to FIG. 4, a partial elevational side view of the connector 10 is shown, with a cut-away section, when the shuttle 18 is at its second position. As seen, the cam surface 78 is at the left end of the cam slot 48. The shunt contacts 16 have their contact sections 70 located between the opposing arms 54 of the first contacts 14 and make electrical contact therewith. In this fashion, groups of two or more first contacts 14 are electrically connected to each other by the shunt contacts 16.

Referring now also to FIG. 5, a partial elevational side view of the assembly of the two connectors 10, 80 is shown with a partial cut-away section. The mating connector 80 is shown fully mated with the connector 10. The pin sections 92 of the third contacts 84 are electrically connected to the first contacts 14. The shuttle 18 has been moved to the right to its first position by the housing 82 of the mating connector 80. More specifically, as the top of the connector 10 is received in the receiving area 86, the wall 87 slides down along the side 38 and, the cam 89 contacts the cam surface 78. As the connectors 10, 80 are further mated, the cam 89 pushes the cam surface 78 to the right; moving along groove 90 and cam slot 48. This automatically moves the shuttle 18 to the right until the shuttle 18 reaches its first position. As seen, the contact sections 70 of the shunt contacts 16 no longer make electrical contact with the first contacts 14. When the mating connector 80 is removed from the connector 10, the cam 88 automatically moves the cam surface 78 back to the left. This, of course, automatically moves the shuttle 18 back to its second position and the shunt contacts 16 are moved back into electrical engagement with the first contacts 14.

The use of shunting of the first contacts 14 is designed to allow shunting of predetermined first contacts when the mating connector 80 (and its electronic device) are disconnected, such as for servicing. In areas, such as telecommunication equipment, this can allow for servicing of the equipment without disruption of service. For example, in a telephone computer system with multiple printed circuit boards, one of the boards could be removed from the system for repair or replacement without shutting down the system. The connector 10 would automatically be activated when the board (with its connector 80) were removed to switch the functions of the removed board to other printed circuit boards of the system. Of course, features of the present invention could be used in any suitable type of system.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector comprising:

a plurality of first electrical contacts;

a housing having the first contacts fixedly connected thereto;

a shuttle movably located inside the housing and having at least one cam surface extending out of an aperture of the housing; and a plurality of second electrical shunt contacts stationarily connected to the shuttle, wherein the cam surface is moved by a mating electrical connector to move the second shunt contacts into and out of electrical contact with the first contacts dependent upon location of the mating electrical connector relative to the housing.

2. A connector as in claim 1 wherein the first contacts each have a male pin section that extends from a bottom of the housing and a female section located in the housing.

3. A connector as in claim 2 wherein the second shunt contacts each have a bridging section and at least two contact sections for contacting the female sections of at least two of the first contacts.

4. A connector as in claim 3 wherein the contact sections all extend in a same first direction.

5. A connector as in claim 1 wherein the shuttle includes a planar section with a plurality of bottom apertures therethrough and multiple compartment sections extending perpendicularly from the planar section with the first contacts located therein.

6. A connector as in claim 5 wherein the shuttle is movably mounted to the housing between two positions along the length of the housing.

7. A connector as in claim 5 wherein at least one of the second shunt contacts has at least two contact sections that extend into two different compartment sections and a bridging section that extends between the two compartment sections.

8. A connector as in claim 7 wherein at least one of the second shunt contacts has a flat planar shape.

9. A connector as in claim 7 wherein at least one of the second shunt contacts has a "U" shape, a base of the "U" shape extending along an exterior longitudinal side of the shuttle.

10. A connector as in claim 1 wherein the housing comprises a base and a cover snap-lock connected to the base.

11. A connector as in claim 1 wherein the aperture is a slot located along a longitudinal side of the housing and the cam surface is adapted to move along the slot.

12. A connector as in claim 1 wherein the shuttle is a single unitary member.

13. An electrical connector assembly comprising:

a first electrical connector having a first housing, a plurality of first electrical contacts, a plurality of second electrical shunt contacts, and means for moving each of the second shunt contacts into and out of electrical contact with at least two of the first contacts; and a second electrical connector having a second housing and a plurality of third electrical contacts, the third contacts being adapted to make electrical contact with the first contacts when the first and second housings are connected to each other, the second housing having a receiving area for receiving a portion of the first housing, and the means for moving being contacted and moved by the second housing between a second position when the second housing is not connected to the first housing and a first position when the second housing is fully mounted on the first housing, wherein the second position comprises the second shunt contacts electrically contacting the first contacts and the first position comprises the second shunt contacts not electrically contacting the first contacts;

wherein the means for comprises a shuttle member movably mounted to the first housing having all of the second shunt contacts stationarily connected thereto and the shuttle member has a cam surface that extends out of an aperture of the first housing, the second housing having a cam adapted to contact and move the cam surface and thereby move the shuttle member when the second connector is contacted to and removed from the first connector, wherein the second housing has a receiving area for receiving a portion of the first housing and, the cam is located on an interior side of a side wall of the second housing.

14. An electrical connector comprising:

a plurality of first electrical contacts;

a plurality of second shunt contacts;

means for moving the second contacts into and out of electrical contact with the first contacts the means for moving having a shuttle member with the second contacts mounted thereon and apertures with the first electrical contacts passing therethrough; and a housing, the housing having a base with the first contracts fixedly connected thereto and a cover connected to the base, the shuttle member being movably mounted to the housing in an area between the base and cover and, adapted to move the second contacts in the area between the base and cover.

15. A connector as in claim 14 wherein the shuttle is a unitary member with a planar section and a plurality of compartment sections extending perpendicularly from the planar section.

16. A connector as in claim 14 wherein the shuttle has a cam surface extending out of a slot in the housing.

17. A connector as in claim 14 wherein the shunt contacts each have a bridging section and two contact sections generally perpendicular to the bridging section.

* * * * *

UNITED STATES PATENT AND TRADEMARK OFFICE

CERTIFICATE OF CORRECTION

PATENT NO. : 5,558,529

DATED : 9/24/96

INVENTOR(S) : Romatzick, Jr.

It is certified that error appears in the above-identified patent and that said Letters Patent is hereby corrected as shown below:

Col. 6, line 58, Claim 13, after "for" insert --moving--.

Signed and Sealed this

Seventeenth Day of December, 1996

*Attest:*

*Attesting Officer*

Bruce Lehman

BRUCE LEHMAN

*Commissioner of Patents and Trademarks*